United States Patent [19]

Przybylinski

[11] 4,250,046

[45] Feb. 10, 1981

[54] DIETHANOL DISULFIDE AS AN EXTREME PRESSURE AND ANTI-WEAR ADDITIVE IN WATER SOLUBLE METALWORKING FLUIDS

[75] Inventor: John L. Przybylinski, West Goshen Township, West Chester County, Pa.

[73] Assignee: Pennwalt Corporation, Philadelphia, Pa.

[21] Appl. No.: 17,218

[22] Filed: Mar. 5, 1979

[51] Int. Cl.[3] ..... C10M 3/06

[52] U.S. Cl. ..... 252/49.3; 252/34.7; 252/48.2; 252/52 A

[58] Field of Search ..... 252/48.2, 49.3, 52 A, 252/34.7

[56] References Cited

U.S. PATENT DOCUMENTS

| | | | |
|---|---|---|---|
| 2,520,748 | 8/1950 | Vaughan et al. | 252/48.2 |
| 2,562,844 | 7/1951 | Harman et al. | 252/48.2 X |
| 3,304,258 | 2/1967 | White et al. | 252/48.2 X |
| 3,374,171 | 3/1968 | Davis | 252/49.3 X |
| 3,526,596 | 9/1970 | Kress et al. | 252/52 A X |
| 3,626,559 | 12/1971 | Rossmann et al. | 252/52 A X |
| 3,847,828 | 11/1974 | Latos | 252/52 A X |

FOREIGN PATENT DOCUMENTS

| | | | |
|---|---|---|---|
| 647911 | 10/1947 | United Kingdom | 252/48.2 |
| 995708 | 8/1963 | United Kingdom | 252/49.3 |

*Primary Examiner*—Andrew Metz

*Attorney, Agent, or Firm*—Robert G. Danehower

[57] ABSTRACT

Metalworking fluids containing diethanol disulfide in effective amounts to provide extreme pressure and anti-wear properties are disclosed. A preferred metalworking fluid is an aqueous solution of diethanol disulfide and water-soluble polyoxyalkylene glycols. Concentrates and use solutions are disclosed.

10 Claims, No Drawings

DIETHANOL DISULFIDE AS AN EXTREME PRESSURE AND ANTI-WEAR ADDITIVE IN WATER SOLUBLE METALWORKING FLUIDS

BACKGROUND OF THE INVENTION

Many lubricants require extreme pressure additives that are based on sulfur compounds. At high contact pressures the metal being worked heats at its surface and reacts with the sulfur forming metallic sulfides which assist in preventing galling and welding of the metal being worked and the metal working tool such as a lathe, drill, punch, saw, nail machine, screw machine, and similar tools. Currently available sulfurized lubricant additives are either not soluble in water and must be formulated as an emulsion or are ionic in nature and form scums in hard water. Examples of these include sulfurized mineral oils, sulfurized unsaturated fats or fatty acids, some synthetic organic sulfur containing compounds, inorganic polysulfides and sulfur bearing salts. Emulsions often do not have great stability; they are liable to attack by bacteria and they leave residues. A further disadvantage is that because of the emulsifier content of the emulsion the lubricating oils on the moving parts of the machine tool may be dragged into the cutting fluid in emulsified form leading to a deterioration of machine performance. A still further disadvantage of emulsions is that they may present a disposal problem when they are discarded. Many times the emulsions must be purposely broken and the oil and water phases disposed of separately to comply with environmental regulations.

Currently used ionic sulfur bearing salts such as salts of mercaptobenzothiazole have the disadvantages of precipitating with heavy metal ions present in ordinary tap water or resulting from oxidation of the metal piece being worked. Because of this, they must be formulated with chelating agents which may accelerate the corrosion of the work piece and machine. Because of its great water solubility, the diethanol disulfide of my invention overcomes the problems associated with emulsions and ionic sulfur bearing salts.

The metalworking fluids of my invention are brought into contact with the metalwork piece by spraying the fluid or by direction a stream of the fluid on the work piece or by immersion of the work piece in the fluid in a manner such that the work piece, metalworking tool and metalworking fluid are all in intimate contact.

SUMMARY OF THE INVENTION

I have now discovered that diethanol disulfide (2,2'-dithiobisethanol) is an efficient water-soluble extreme pressure and anti-wear additive for aqueous lubricant systems without the disadvantages of the sulfur containing extreme pressure additives described above. Diethanol disulfide is an organic, non-ionic compound soluble in water in all proportions. It has a sulfur content generally in excess of 40% by weight in a chemical structure which makes it a very efficient and desirable extreme pressure and anti-wear additive. Diethanol disulfide will not precipitate out of solution in hard or acidic water. It has additional advantages of low odor, and light color; it does not foam.

In one aspect of my invention, a metal workpiece is worked by engaging it with a metalworking tool while in intimate contact with an effective amount of the metalworking fluid of my invention. This fluid comprises a major portion of water and an effective amount of diethanol disulfide to provide extreme pressure resistant properties and anti-wear properties to the metalworking fluid. Optionally, effective amounts of one or more conventional metalworking fluid additives can be present such as a lubricating agent, rust preventative, wetting agent, defoamer, germicide, chelating agent, non-ferrous metal corrosion inhibitor, dye and perfume.

In another aspect of my invention, I have discovered that mixtures of diethanol disulfide and water-soluble polyoxyalkylene glycols having a minimum molecular weight of about 100 in water show synergistic activity when used in effective amounts to provide extreme pressure and anti-wear properties at high loads in metalworking fluids. Diethanol disulfide exhibits extreme pressure and anti-wear properties at concentrations as low as 0.05% by weight in water. Optionally, effective amounts of one or more conventional metalworking fluid additives can be present such as a lubricating agent, rust preventative, wetting agent, defoamer, germicide, chelating agent, non-ferrous metal corrosion inhibitor, dye and perfume.

Diethanol disulfide is an efficient extreme pressure additive and anti-wear agent in its own right and can be the sole agent of this type in my metalworking fluids. However, for special work jobs, other extreme pressure and anti-wear additives may be combined with diethanol disulfide in my metalworking fluids.

DETAILED DESCRIPTION OF THE INVENTION

I have now discovered that diethanol disulfide ($HOC_2H_4S_2C_2H_4OH$) is a highly efficient extreme pressure and anti-wear additive for water-based metalworking fluids. Its sulfur content is in excess of about 40% by weight but it still retains its solubility in water in all proportions, even in the presence of heavy metal ions. It is a transparent liquid, with a viscosity of 53 Centistokes at 40° C.

Diethanol disulfide can be prepared by reacting two moles of 2-mercaptoethanol with one mole of sulfur in the presence of a basic catalyst such as triethylamine. The by-product hydrogen sulfide is removed from the reaction mixture by passing air or other inert gas through it at about 100° C. When prepared in this manner, minor amounts of diethanol trisulfide and higher diethanol polysulfides are also produced. These products are not as useful as diethanol disulfide as metalworking fluid additives because of their limited solubility in water. The 2-mercaptoethanol is commercially available from a number of manufacturers.

The theoretical sulfur content of diethanol disulfide is 41.58% by weight. The sulfur content of diethanol disulfide when prepared in the manner described above may vary between 37% and 46% by weight because of mixtures of small amounts of thiodiethanol and diethanol polysulfides. When I use the term diethanol disulfide in the specification and claims, I intend to include diethanol disulfide having a sulfur content between 37 and 46% by weight.

I have found diethanol disulfide to be useful as a E.P. (extreme pressure) and anti-wear additive for water-based metalworking fluids such as in milling, grinding, cutting, tapping, machining, and sawing fluids. Its value as an E.P. and anti-wear additive is enhanced when combined with polyoxyalkylene glycols with which it acts synergistically in the water-based metalworking fluids.

The metalworking fluids of my invention contain a minimum of about 0.05% by weight of diethanol disulfide. Any higher concentration can be used as an E.P. and anti-wear additive but concentrations in excess of about 1% by weight of the metalworking fluid are uneconomical. A preferred concentration range is about 0.05 to 0.2% by weight.

Normally, diethanol disulfide would be the sole E.P. and anti-wear additive in my metalworking fluids. However, for special metalworking jobs, I have found that other E.P. and anti-wear additives may be present along with the diethanol disulfide such as emulsified ditertiarynonyl polysulfide, salts and esters of sulfurized oleic acid, salts of mercaptobenzothiazole and polyoxyethylene bis(thiourea).

A preferred member of my metalworking fluids is at least one water soluble polyoxyalkylene glycol having a minimum molecular weight of about 100. Preferably, the glycol is selected from the group consisting of polyoxyethylene glycols, polyoxypropylene glycols and mixed polyoxyethylene-polyoxypropylene glycols. By water soluble is meant water soluble at ordinary ambient temperatures, as some polyoxyalkylene glycols became insoluble at elevated temperatures and the use of such glycols is in fact preferred. In terms of molecular weights of polyoxyalkylene glycols must have a minimum molecular weight of about 100. The upper limit of the molecular weights is determined by their being water-soluble at ambient temperature. It is desirable to use the highest molecular weight polyoxyalkylene glycol which is water soluble at ambient room temperature in my metal-working fluids. Polyoxyethylene glycols with molecular weights as high as about 600 have been used in my metal-working fluids. Polyoxyproylene glycols with molecular weights as high as about 400 have been used in my metal-working fluids. Mixed polyoxypropylene-polyoxyethylene glycols with molecular weights as high as about 3500 have been used in my metalworking fluids.

The polyoxyalkylene glycols are used at a minimum concentration of about 0.05% by weight. Any higher concentration of polyoxyalkylene glycols can be used in my metalworking fluids so long as they are water soluble. Concentrations in excess of about 5% by weight of the metalworking fluid are less economical. Preferred use concentrations may vary from about 0.2 to 0.6% by weight.

In addition to or in place of the polyoxyalkylene glycols, the metalworking fluids of my invention may contain effective amounts of one or more conventional metalworking fluid additives, such as lubricity agents, rust preventatives, wetting agents, defoaming agents, germicidal agents, chelating agents and non-ferrous metal corrosion inhibitors, dyes and perfumes. One important criteria for all of these various additives is that they be water-soluble at ambient temperatures. By effective amount of conventional metalworking fluid additive is meant the minimum concentration of the additive which will produce the effect desired in the metalworking fluid. The effective amount of the conventional additives for metalworking fluids described above are well known to chemists skilled in the formulation of such fluids. Generally, these conventional metalworking additives will be present in my use solutions at concentrations of at least about 0.001% and generally ranging from about 0.001% to 5% by weight.

Lubricating agents (lubricity additives) are very desirable in my metalworking fluids since they effectively lower the power required to effect the metalworking operation. Suitable lubricity additives are the fatty acid soaps derived from ethanolamine, diethanolamine or triethanolamine. The fatty acid moieties are selected from the $C_6$ to $C_{22}$ fatty acids. Typical fatty acids useful in my metal-working fluids are oleic, caprylic, myristic and tall oil fatty acids. Sulfurized fatty acids are also useful in my metal-working fluids. The concentration range of the ethanolamine fatty acid soaps in my use solutions will range from about 0.1% to 5% by weight.

In place of adding the ethanolamine fatty acid soaps to my metalworking fluids it is satisfactory to separately add the ethanolamine and the fatty acid. Generally, the ethanolamine and fatty acid are added in stoichiometric quantities. The soaps will form in situ. An excess of the ethanolamine may be added to adjust the pH as desired.

Typical rust preventatives useful in my metalworking fluids are inorganic borates such as sodium tetraborate, sodium tetraborate decahydrate and triethanolammonium borate; boramides such as sodium boramide; nitrites, especially sodium nitrite; nitrates such as sodium and zinc nitrate; phosphates such as potassium tripolyphosphate, sodium hydrogen phosphate, sodium orthophosphate and triethanolammonium phosphate; polyoxyethylene fatty amines and amides such as 2-(hydroxydiethoxy)dodecyl N,N bis(hydroxydiethoxyethyl)amine and N,N bis(hydroxytetraethoxyethyl)tetradecyl amide are also useful as well as arylsulfonamidocarboxylic acids such as the triethanolammonium salt of benzene-sulfonyl-N-methyl-ε-aminocaproic acid. Rust preventatives are generally used at a concentration of about 0.4 to 1% by weight.

Typical wetting agents useful in my metalworking fluids are ethanolamine myristate, triethanolammonium laurate, hydroxypentadecaethoxy(nonylbenzene), hydroxynonaethoxyethyl(octyl phosphate), and 1-octyloxy-2-(hydroxypentaethoxy)-3-butoxypropane. Wetting agents are generally used in my metalworking fluids at a concentration of about 0.02 to 5% by weight.

Typical defoamers useful in my metalworking fluids are glycol polysiloxane, polydimethylsiloxane, and other siloxanes, 2 ethylhexanol and tributylphosphate. Defoaming agents are used at a concentration range of seven parts per million to about 0.01% by weight.

Typical germicides include sodium salt of 2-mercaptopyridine-N-oxide, hexahydro-1,3,5-tris(2-hydroxyethyl)-S-triazine, and 1,2 benzisothiazolin-3-one. Germicides are generally used in a concentration range of about 0.005 to 0.05% by weight.

Examples of chelators useful in my metalworking fluids are sorbitol, mannitol, ascorbic acid, sorbose, tannic acid, salts of ethylenediaminetetraacetic acid, sucrose, tartaric acid, mannose and the like. Chelators may be used in concentrations of about 0.005 to 0.2% by weight.

Suitable non-ferrous metal corrosion inhibitors for my metalworking fluids are benzotriazole and its related compounds such as tolyltriazole, diheptyltriazole and diphenyltriazole. These inhibitors along with dyes and perfume, if desired, are generally used at concentrations ranging from 0.001 to 0.1% by weight.

For purposes of economy in transportation costs, the aqueous solutions of my metalworking fluids are marketed as water-based concentrates of the use solutions described above. The concentrates are shipped to the metalworking fabricator who will then dilute the concentrates with water to the desired use concentration.

As used in this application, the water-based concentrates of my invention comprise aqueous concentrates having in excess of about 0.5% by weight of diethanol disulfide. They may also contain in excess of about 0.1% by weight of one or more, water-soluble polyoxyalkylene glycols having a minimum molecular weight of about 100.

A typical concentrate of my metalworking fluids comprises about 2 to 10% by weight diethanol disulfide, 4 to 20% by weight of one or more, water-soluble polyoxyalkylene glycols having a minimum molecular weight of about 100, with the remainder being water.

Another concentrate of my invention will comprise about 2 to 10% by weight of diethanol disulfide, about 4 to 20% by weight of one or more water-soluble polyoxyalkylene glycols having a minimum molecular weight of about 100, about 4 to 20% by weight of at least one water-soluble amine fatty acid soap of the type described above in connection with the use solutions, with the remainder being water.

Another concentrate of my invention will comprise about 20% by weight of diethanol disulfide, about 20% by weight of a lubricity additive with the remainder being water.

The concentrates may also contain one or more of the conventional metalworking additives described above including rust preventatives, wetting agents, defoamers, germicides, chelators, non-ferrous corrosion inhibitors, dyes and perfumes. These optional metalworking additives if used in the concentrates of my invention will be present at a concentration in excess of the concentration described above for the use solutions. Typical concentrations of these conventional additives in my concentrates are rust preventative—10% by weight, wetting agent—5% by weight, defoamer—1% by weight, germicide—1% by weight, chelator—0.1% by weight, non-ferrous metal corrosion inhibitor—0.01% by weight, dye—0.01% by weight and perfume—0.01% by weight.

Concentrates having a percentage of ingredients higher than those described above are technically feasible with the higher concentrations being limited only by the product cost in a highly competitive market place.

The metalworking fluids of my invention are easily prepared by merely combining the ingredients in a container and briefly agitating the mixture.

The concentrates described above are diluted by the metal processor with water to form the metalworking use solutions of my invention. In using the metalworking fluids, the metal workpiece is engaged by a machine tool while in intimate contact by spraying or immersion in the metalworking fluids of my invention. The diethanol disulfide concentration can be varied by using varying amounts of the concentrate to provide effective extreme pressure properties and anti-wear properties as required.

The best mode of practicing my invention is shown in the following examples. The E.P. properties and anti-wear properties of my water-based metalworking fluids were determined by FALEX tester under ASTM D3233 for E.P. properties and under ASTM D2670 TM for anti-wear properties. Certain of the metalworking fluids were tested with the Four Ball test procedure under ASTM D2783 from which is derived the Load Wear Index measurement.

In the FALEX test procedure samples were run for 300 seconds at a jaw load of 250 lb. Thereafter the load was increased in 250 lb. increments using the automatic ratchet device. Each successive load was maintained for 60 seconds. If necessary the ratchet device was briefly re-engaged to maintain load. The number of teeth on the ratchet wheel needed to maintain the load was recorded as the "wear" figure in Table 2. This number is directly related to the wear of the test pin and V jaws. The torque on the test pin was also recorded. Torque measured in inch-pounds is directly related to the lubricity of the fluid. Loads were increased until the load could not be increased or maintained by the automatic ratchet device (wear failure), or the test pin broke. The load at the point of failure is directly related to the extreme pressure performance.

The wear figures in Table 4 were determined in separate experiments of 15 minutes duration to improve the accuracy of wear data. The weight loss of the FALEX pins as well as the number of ratchet teeth needed to maintain load were determined.

EXAMPLE 1

A typical metal working fluid in accord with my invention is shown as Fluid A in Table 1 in which lubricity is supplied by ethanolamine and oleic acid. The E.P. additive, diethanol disulfide is at 0.1 percent by weight concentration. Fluid B was formulated without the E.P. additive for comparative testing. Fluid C represents a commercial metalworking fluid in which the E.P. additive is sulfurized ester of oleic acid. The ingredients for all three of the metalworking fluids are shown in Table 1 below. The synergistic action of diethanol disulfide with polyoxyalkylene glycol was examined by testing fluids D, E and F shown in Table 1. All percentages are by weight.

TABLE 1

| | Metal Working Fluids at Use Concentrations | | | | | |
|---|---|---|---|---|---|---|
| | FORMULATION | | | | | |
| Component | A | B | C | D | E | F |
| Diethanol Disulfide | 0.1% | 0 | 0 | 0 | 0.2% | 0.2% |
| Sulfurized Ester of Oleic Acid | 0 | 0 | 0.34% | 0 | 0 | 0 |
| 400 MW Polyoxypropylene Glycol | 0.4% | 0.4% | 0 | 1.0% | 1.0% | 0 |
| Ethanolamine | 0.2% | 0.2% | 0 | 0 | 0 | 0 |
| Triethanolamine | 0 | 0 | 0.75% | 0 | 0 | 0 |
| Oleic Acid | 0.3% | 0.3% | 0 | 0 | 0 | 0 |
| Sodium Nitrite | 0 | 0 | 0.2% | 0 | 0 | 0 |
| Sorbitol | 0.05% | 0.05% | 0.05% | 0 | 0 | 0 |
| Couplers, Dyes, antifoams | 0 | 0 | <0.05% | 0 | 0 | 0 |
| Water | Balance | Balance | Balance | Balance | Balance | Balance |

The anti-wear and E.P. properties of the fluids in Table 1 were tested on a FALEX tester. The results are shown in Table 2 below.

The test results on the E.P. and anti-wear properties of the metalworking fluids at the use concentrations shown in Table 3 appear in Table 4.

TABLE 2

| | Falex Tests | | | | | | | | | | | |
|---|---|---|---|---|---|---|---|---|---|---|---|---|
| | FORMULATION A | | FORMULATION B | | FORMULATION C | | FORMULATION D | | FORMULATION E | | FORMULATION F | |
| Load (lbs.) | Wear | Torque (inch lbs.) | Wear | Torque (inch lbs.) | Wear | Torque (inch lbs.) | Wear | Torque (inch lbs.) | Wear | Torque (inch lbs.) | Wear | Torque (inch lbs.) |
| 250 | 0 | 7 | 0 | 8 | — | 9 | Wear Failure | | 5 | 29–34 | Wear Failure | |
| 500 | 0 | 12 | 0 | 13 | — | 13 | | | 5 | 53–51 | | |
| 750 | 0 | 18 | 0 | 18 | — | 18 | | | 3 | 60–59 | | |
| 1000 | 0 | 22 | 1 | 22 | — | 22 | | | 5 | 65–66 | | |
| 1250 | 0 | 26–25 | 1 | 26 | — | 28–26 | | | 4 | 61–55 | | |
| 1500 | 0 | 28 | 4 | 31–29 | — | 31–32 | | | 2 | 58–53 | | |
| 1750 | 6 | 32–30 | 11 | 34–32 | — | 38 | | | 3 | 56–52 | | |
| 2000 | 7 | 34 | 22 | 37–35 | — | 43–42 | | | 8 | 60–59 | | |
| 2250 | 9 | 37 | 15 | 38 | * | 52–44 | | | 12 | 65–61 | | |
| 2500 | 16 | 41 | 27 | 40–38 | 17 | 52–45 | | | 18 | 67 | | |
| 2750 | 18 | 46 | 32 | 43–42 | ** | 50 | | | 36 | 72–68 | | |
| 3000 | 25 | 48 | 50 | 44–43 | Pin Broke | | | | 40 | 71–68 | | |
| 3250 | 140 | 53 | Pin Broke | | | | | | 45 | 70–63 | | |
| 3500 | Pin Broke | | | | | | | | 35 | 66 | | |
| 3750 | | | | | | | | | Wear Failure | | | |

*Load drop-off indicated easily measurable wear at this load, number of teeth not measured.
**Load drop-off indicated great wear at this load, number of teeth not measured.

A comparison of the FALEX test results in Table 2 for fluids A, B and C shows the efficiency of diethanol disulfide as an E.P. and anti-wear additive and its superiority to a commercial metalworking fluid using sulfurized ester of oleic acid as E.P. additive.

The synergistic action of diethanol disulfide with polyoxyalkylene glycol is readily observed by comparing FALEX tests results in Table 2 for fluids D, E and F.

EXAMPLE 2

The metalworking fluids shown in Table 3 were formulated as concentrates. Thereafter 5 parts by weight of the concentrates were diluted with 95 parts by weight of water to form the use solutions which were then tested for E.P. and anti-wear qualities by Falex and Four Ball test procedures.

In the Four-Ball test, one steel ball is rotated at 1770+60 rpm for 10 seconds against three steel balls held stationary in the form of a cradle. The loads on the ball are increased in intervals of 0.1 logarithmic units until welding occurs. Welding is indicated by actual welding, as indicated by a scar diameter on the stationary balls exceeding 4 mm, or, as in this case, sudden loud screeching or grinding noises from the balls.

The weld load is an indication of the extreme pressure carrying capability of the fluid. The load Wear Index is a calculated average number that indicates the combined load carrying (E.P.) and anti-wear qualities of the fluid.

TABLE 4

| | EP and Anti-wear Tests on Metalworking Fluids | | | |
|---|---|---|---|---|
| | B-1 | B-2 | B-3 | B-4 |
| Falex Test Results | | | | |
| EP (ASTM D3233) | 1000, 1250 | 3750* | 4250, 4000* 2750* | 3000, 3750* |
| Wear (Similar to ASTM D2670) | | | | |
| 1000 lb., 15 min. | | | | |
| No. of Teeth | Seizure | 55* | 43* | 6* |
| Pin wt. loss (mg) | — | 60* | 48* | 8* |
| 2000 lb., 15 min. | | | | |
| No. of Teeth | unable to test | 147* | 82* | 91* |
| Pin wt. loss (mg) | unable to test | 55 | 63 | 69* |
| Four-Ball Test Results | | | | |
| (ASTM D2738) | | | | |
| Weld Load | 50 | 80 | 100 | 80 |
| Last Non-Seizure Load | 16 | 24 | 32 | 32 |
| Load Wear Index | 10.4 | 15.3 | 15.9 | 17.6 |

*Test run with fluid circulating through the test cup at 100–200 ml/min. from a sump held at 50 ± 3° C. (122 ± 5° F.).

The effectiveness of diethanol disulfide as an E.P. and anti-wear additive is seen in the FALEX tests and Four Ball tests where increasing amounts of the diethanol disulfide additive gave failures at loads increasing from 1250 without the additive to as high as 4250 with 0.1% of diethanol disulfide. The FALEX test results are supported in the Four Ball tests with weld load increasing from 50 to as high as 100 with 0.1% diethanol disulfide, last non-seizure load increasing from 16 to 32, and load

TABLE 3

| | Metal Working Fluid Concentrates and Use Solutions | | | | | | | |
|---|---|---|---|---|---|---|---|---|
| | B-1 | | B-2 | | B-3 | | B-4 | |
| Ingredient | Concentrate | Use | Concentrate | Use | Concentrate | Use | Concentrate | Use |
| Caprylic Acid | 3.0% | 0.15 | 3.0% | 0.15 | 3.0 | 0.15 | 3.0% | 0.15 |
| Ethanol-amine | 1.5% | 0.075 | 1.5% | 0.075 | 1.5% | 0.075 | 1.5% | 0.075 |
| PPG 400* | 12.0% | 0.6 | 12.0% | 0.60 | 12.0% | 0.60 | 12.0% | 0.60 |
| Diethanol disulfide | 0.0% | 0.0 | 1.0% | 0.05 | 2.0% | 0.10 | 4.0% | 0.20 |

*Polyoxypropylene glycol-M.W. 400 wear index increasing from 10.4 to 17.6 with 0.2% diethanol disulfide.

I claim:

1. A water-soluble metalworking fluid comprising at least 0.05% by weight of diethanol disulfide, at least about 0.05% by weight of one or more water-soluble polyoxyalkylene glycols having a minimum molecular weight of about 100, with the balance being water.

2. The metalworking fluid of claim 1 in which the water-soluble polyoxyalkylene glycol is selected from the group consisting of water-soluble polyoxyethylene glycol, polyoxypropylene glycol and mixed polyoxyethylene-polyoxypropylene glycol having a minimum molecular weight of about 100.

3. The metalworking fluid of claim 1 in which the diethanol disulfide is present at a concentration in the range of 0.05 to 0.2% by weight and the polyoxyalkylene glycols having a minimum molecular weight of about 100 is present at a concentration in the range of 0.05 to 0.6% by weight.

4. A water-soluble metalworking fluid comprising from about 0.05% to 1% by weight of diethanol disulfide, from about 0.05% to 5% by weight of one or more water-soluble polyoxyalkylene glycols selected from the group consisting of polyoxyethylene glycol, polyoxypropylene glycol and mixed polyoxyethylene-polyoxypropylene glycol, having a minimum molecular weight of about 100, an effective amount of at least one water-soluble metalworking fluid additive selected from the group consisting of lubricity agent, rust preventative, wetting agent, defoaming agent, germicidal agent, chelating agent, nonferrous metal corrosion inhibitor, dye and perfume, with the balance being water.

5. The metalworking fluid of claim 4 in which the water-soluble metalworking fluid additive is at least one water-soluble lubricity agent selected from the group consisting of ethanolamine, diethanolamine and triethanolamine fatty acid soaps in which the fatty acid moieties are derived from $C_6$ to $C_{22}$ fatty acids.

6. The metalworking fluid of claim 4 in which the alkanolamine is triethanolamine and the fatty acid is oleic acid.

7. The water-soluble metalworking fluid comprising from at least about 0.05% by weight of diethanol disulfide, from at least about 0.05% by weight of one or more water-soluble polyoxyalkylene glycols selected from the group consisting of polyoxyethylene glycol, polyoxypropylene glycol, and mixed polyoxyethylene-polyoxypropylene glycol, having a minimum molecular weight of about 100, an effective chelating amount of sorbitol, with the balance being water.

8. A concentrate for preparing a water-soluble metalworking fluid comprising from about 2 to 10% by weight of diethanol disulfide, from about 4 to 20% by weight of one or more water-soluble polyoxyalkylene glycols selected from the group consisting of polyoxyethylene glycol, polyoxypropylene glycol and mixed polyoxyethylene-polyoxypropylene glycol, having a minimum molecular weight of about 100, an effective amount of at least one water-soluble metalworking fluid additive selected from the group consisting of lubricity agent, rust preventative, wetting agent, defoaming agent, germicidal agent, chelating agent, nonferrous metal corrosion inhibitor, dye and perfume, with the balance being water.

9. A concentrate for preparing a water-soluble metalworking fluid comprising from about 2–10% by weight of diethanol disulfide, from about 4–20% by weight of one or more water-soluble polyoxyalkylene glycols having a minimum molecular weight of about 100, from about 4–20% by weight of at least one water-soluble amine fatty acid soap selected from the group consisting of ethanolamine fatty acid soap, diethanolamine fatty acid soap, and triethanolamine fatty acid soap in which the fatty acid moieties range from $C_6$ to $C_{22}$ fatty acids, with the balance being water.

10. A concentrate for preparing a water-soluble metalworking fluid comprising from about 2–10% by weight of diethanol disulfide, from about 4–20% by weight of one or more water-soluble polyoxyalkylene glycols having a minimum molecular weight of about 100, from about 4–20% by weight of at least one water-soluble amine fatty acid soap selected from the group consisting of ethanolamine fatty acid soap, diethanolamine fatty acid soap, and triethanolamine fatty acid soap in which the fatty acid moieties range from $C_6$ to $C_{22}$ fatty acids, at least 0.01% by weight of one or more water-soluble metalworking fluid additives, selected from the group consisting of lubricity agent, rust preventative, wetting agent, defoaming agent, germicidal agent, chelating agent, nonferrous metal corrosion inhibitor, dye and perfume, with the balance being water.

* * * * *